United States Patent [19]

Rende et al.

[11] Patent Number: 4,657,946

[45] Date of Patent: Apr. 14, 1987

[54] PAPER SIZING METHOD AND EMULSION

[75] Inventors: Dominic S. Rende, Woodridge; Michael D. Breslin, Downers Grove, both of Ill.

[73] Assignee: Nalco Chemical Company, Oak Brook, Ill.

[21] Appl. No.: 755,503

[22] Filed: Jul. 16, 1985

Related U.S. Application Data

[63] Continuation-in-part of Ser. No. 625,476, Jun. 25, 1984, abandoned, which is a continuation-in-part of Ser. No. 574,324, Jan. 27, 1984, abandoned.

[51] Int. Cl.[4] ..... B05D 3/02; D21D 3/00

[52] U.S. Cl. ..... 523/402; 427/391; 524/555; 524/560; 525/285; 525/386

[58] Field of Search ..... 524/555, 560; 525/285, 525/386; 427/391; 523/402

[56] References Cited

U.S. PATENT DOCUMENTS

| | | | |
|---|---|---|---|
| 3,102,064 | 8/1963 | Wurzburg et al. | 162/158 |
| 3,821,069 | 6/1974 | Wurzburg | 162/168.4 |
| 3,968,005 | 7/1976 | Wurzburg | 162/179 |
| 4,040,900 | 8/1977 | Mazzarella et al. | 162/184 |
| 4,395,499 | 7/1983 | Rosenski et al. | 524/555 |
| 4,415,717 | 11/1983 | Nieth | 524/555 |
| 4,418,175 | 11/1983 | Probst et al. | 524/555 |

*Primary Examiner*—Ronald W. Griffin

*Attorney, Agent, or Firm*—John G. Premo; Robert A. Miller; Donald G. Epple

[57] ABSTRACT

Cationically charged water soluble vinyl addition polymers and condensation polymers provide improved emulsification of alkenyl succinic anhydride sizing agents. Sized paper products prepared from alkenyl succinic anhydride emulsions made with the polymers have superior ink holdout.

12 Claims, 1 Drawing Figure

RECIRCULATION RATE = 0.5 GPM
ALKENYL SUCCINIC ANHYDRIDE CONCENTRATION = 0.1%
RECIRCULATION TEMPERATURE = 120 DEGREES F

FELT FILLING POTENTIAL
ALKENYL SUCCINIC ANHYDRIDE EMULSIONS WITH CATIONIC CARRIERS

RECIRCULATION RATE = 0.5 GPM
ALKENYL SUCCINIC ANHYDRIDE CONCENTRATION = 0.1%
RECIRCULATION TEMPERATURE = 120 DEGREES F

PAPER SIZING METHOD AND EMULSION

This application is a continuation-in-part application from U.S. Ser. No. 625,476, filed 6/25/84, now abandoned, which in turn was a continuation-in-part application of U.S. patent application No. 574,324, filed 1/27/84, now abandoned.

Alkenyl succinic anhydrides (ASA) useful in the sizing of cellulosic materials have gained considerable commercial success. These materials were first fully disclosed in U.S. Pat. No. 3,102,064 which is hereinafter incorporated by reference. This patent discloses a certain class of chemical materials generally having the structural formula

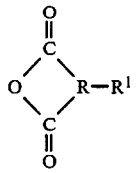

wherein R represents a dimethylene or trimethylene radical, and wherein $R^1$ is a hydrophobic group containing more than 5 carbon atoms which may be selected from the group consisting of alkyl, alkenyl, aralkyl or aralkenyl groups.

In describing the use of the ASA sizes disclosed in this reference, the patentee indicates that for effective utilization, the sizing agents must be used in conjunction with a material which is either cationic in nature or is, on the other hand, capable of ionizing or disassociating in such a manner to produce one or more cations or other positively charged groups. The cationic agents as they are defined in this reference are disclosed as "alum, aluminum chloride, long chain fatty amines, sodium aluminate, polyacrylamide, chromic sulfate, animal glue, cationic thermosetting resins, and polyamide polymers". The patentee particularly points out as preferred cationic agents various cationic starch derivatives including primary, secondary, tertiary, or quarternary amine starch derivatives and other cationic nitrogen substituted starch derivatives, as well as cationic sulfonium and phosphonium starch derivatives. Such derivatives, as stated by the patentee, may be prepared from all types of starches including corn, tapioca, potato, etc.

With the growing commercial use of sizes of the type above described, serious problems have remained in the application of the sizes to paper stock or pulp prior to its formation into sheet or other useful forms. Part of the problem has been that the ASA sizing materials are not water soluble, and must, accordingly, be uniformly suspended in the pulp so that the size can make adequate contact with the cellulosic fibers and thus create the desired effect on the final product.

Another problem is that the use of cationic starches and/or other high molecular weight cationic polymers cause the formation of machine deposits and accompanying runnability problems in the form of press picking, felt filling, and poor cylinder vat consistency control.

While the cationic agents disclosed in U.S. Pat. No. 3,102,064 have met with some success, there has been a need within the paper industry to produce a more effective, "cationic agent" for ASA sizes to avoid the deposit problems and felt filling problems mentioned above. In addition, such cationic agent would preferably aid in the retention of the size on the fiber, and would increase, where desired, the wet and/or dry strength of the final sheet material.

It is accordingly an object of this invention to provide to the art a group of additives which will serve to emulsify or disperse the ASA size in the pulp and allow for retention of the size onto the fiber.

It is another object of this invention to provide an ASA size formulation which, when applied during the paper manufacturing process, will obtain superior sizing results and retention results while minimizing or eliminating machine deposits which can cause felt filling, press picking deposition and poor emulsion stability in storage.

A further object of this invention is the use of water soluble cationic vinyl addition polymers having relatively low molecular weights above 10,000 and preferably below 1,000,000 either as sole emulsifiers or as co-emulsifiers for ASA sizing materials, thereby eliminating machine deposit and runnability problems.

Further objects will appear hereandafter.

THE INVENTION

Our invention, as briefly stated above, is to utilize cationic water soluble vinyl addition polymers having molecular weights greater than 10,000 and preferably below 1,000,000 as additives and co-emulsifying agents for ASA sizes. The use of such cationic vinyl addition polymers serve as useful co-emulsifying agents for ASA size, and in addition, increases the retention of the size upon the cellulosic sheet, without the machine deposit and runnability problems of the formulated sizes of the prior art.

The ASA sizes to which this invention is applicable include those mentioned in U.S. Pat. Nos. 3,102,064, 4,040,900, 3,968,005, and 3,821,069, all of which are hereinafter incorporated by reference.

The ASA sizes useful in the subject of this invention are generally described by the following structural formula:

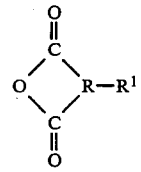

wherein R represents a dimethylene or trimethylene radical, and wherein $R^1$ is a hydrophobic group containing more than 5 carbon atoms which may be selected from the group consisting of alkyl, alkenyl, aralkyl or aralkenyl groups.

THE SURFACTANT

In a particularly useful embodiment of this invention, a surfactant may optionally be employed in making the ASA sizes of this invention. This surfactant, when employed, may be anionic, non-ionic, or cationic in nature, but is preferably anionic in nature. Most preferably, the surfactant is chosen from the group consisting of phosphated ethoxylates, which may contain alkyl, aryl, alkaryl, or alkenyl hydrocarbon substituents, or from sulfonated products such as those obtained from sulfonating fatty alcohols, aromatic fatty alcohols, wherein the non-aromatic portion may contain alkyl, alkenyl, branched, or aralkyl substituents. Surfactants employed have generally been water soluble and have had HLB values ranging from about 8 to about 30 or higher, and preferably from about 8–25. The surfactant is generally used to prepare the ASA size by simply mixing it with the raw ASA material. The ASA size used in this invention accordingly, and in a preferred embodiment of this invention, will generally contain 85–99.5 parts by weight of ASA and preferably 90–99 parts by weight of ASA with 0.5–15 parts, preferably 0.50–5 parts, and most preferably 0.75–2.5 parts by weight of an anionic surfactant. It has been noticed that use of these type of surfactants at levels exceeding 2.5 parts in conjunction with the ASA size can detract from sizing effectiveness. This is particularly true when non-ionic surfactants are used in the ASA size formulations.

One of the advantages with our invention is that the ASA size formulation containing the low molecular weight cationic vinyl polymers may be emulsified without high concentrations of other surfactants, as above. The lower the concentration of emulsifier or surfactant, the better the sizing results on paper from the use of the ASA sizing emulsified formulations. In fact, in the ultimate extension of our invention, the ASA size emulsified formulations may be added to paper processes without any other emulsifying agent being present. The use of our low molecular weight cationic vinyl polymers can eliminate the need for, or make optional the use of other emulsifying agents.

The surfactants, when used, are preferably added to the ASA prior to emulsification in the aqueous medium. Surfactant can also be added to the aqueous medium prior to the addition of the ASA. Preferably the surfactant, when used, is added to the ASA directly.

The surfactants which can be useful in this invention are further described in U.S. Pat. No. 4,040,900 previously incorporated by reference into this specification. The relevant parts of U.S. Pat. No. 4,040,900 begin at column 4, line 54 continue through column 5, line 46. Other portions of this patent are, however, relevant.

Other classes of materials potentially useful as the surfactants in this invention include: ethoxylated alkyl phenols, such as nonyl phenoxy polyethoxy ethanols and octyl phenoxy polyethoxy ethanols; polyethylene glycols such as PEG 400 mono-oleate, and PEG 600 dilaurate; as well as other materials including certain ethoxylated phosphate esters.

Preferred surfactants for use in our invention i.e. when used in combination with the low molecular weight cationic vinyl polymers to be described, are GAFAC RM510 and GAFAC RE610, both free acids of complex organic phosphate esters, manufactured by the GAF Corporation. When these preferred surfactants are used, the concentration rarely exceeds about 1.0 percent, and preferably ranges between about 0.5–0.75 percent of the sizing formulation.

THE WATER SOLUBLE POLYMERS

Water soluble polymers which are useful cationic agents in this invention include water soluble vinyl addition homopolymers and copolymers having molecular weights greater than 10,000, but preferably below 1,000,000, where at least 10 weight percent and up to 100 weight percent of the mer content of the polymer is a cationic vinyl monomer, or cationically modified monomer. Preferably at least 15 and up to 95 weight percent of the mer units in the polymer may be cationic or cationically modified monomers. Most preferably from 20–75 weight percent by weight of the mer units in the polymer or copolymer are cationic or cationically modified.

The polymers selected for use in this invention generally have a molecular weight of greater than 10,000 and less than 1,000,000. Polymers of this type should generally be water soluble, and an especially preferred molecular weight has been found to be between 20,000 and 750,000. Most preferably, the molecular weights of the polymers employed range from 50,000 to 150,000. Polymers having molecular weights greater than 1,000,000 can be employed so long as they are water soluble, however, higher molecular weights can lead to increased felt filling, press picking, and machine deposit problems.

Polymers which can be employed in the practice of this invention include, but are not limited to the following exemplary copolymers and homopolymers:

acrylamide-dimethylaminoethylacrylate,
acrylamide-dimethylaminoethylacrylate quaternaries,
acrylamide-diethylaminoethylacrylate,
acrylamide-diethylaminoethylacrylate quaternaries,
acrylamide-dimethylaminoethylmethacrylate,
acrylamide-dimethylaminoethylmethacrylate quaternaries,
acrylamide-diallyldimethyl ammonium chloride,
polydiallyl-dimethyl ammonium chloride,
polydimethylaminoethylmethacrylate and its quaternaries,
polymethacrylamidopropyltrimethyl ammonium chloride; and,
acrylamide-methacrylamidopropyltrimethyl ammonium chloride.

Also useful are polymers and copolymers of acrylamide which have been subjected to a "Mannich" reaction with formaldehyde and a lower alkyl secondary amine. These Manniched polyacrylamide polymers may or may not be quaternized.

As seen, all of the polymers useful in this invention are cationically charged and are water-soluble. Many are prepared from vinyl addition monomers, although condensation polymers will also work. Since the number of possible cationically charged monomers that will produce a water soluble polymer is essentially unlimited, and it is expected that all water-soluble cationically charged vinyl addition or condensation polymers having a molecular weight of 10,000 or more or preferably with a molecular weight of less that 1,000,000 and which retain water solubility will work, we do not wish to be limited to the above given list.

The polymers employed, as stated above, may be copolymers and even terpolymers of various vinyl addition monomers. While acrylamide is a preferred nonionic monomer for use in preparing copolymers useful in this invention, other nonionic monomers such as methacrylamide and even certain anionically charged monomers such as acrylic acid, methacrylic acid, various sulfonated water soluble vinyl addition monomers, etc. can be employed.

Polymers as used in this invention may be in the form of water-in-oil emulsions (which as those described in U.S. Pat. Nos. Re. 28,474 and 28,576, both of which are hereinafter incorporated by reference), dry powders, or aqueous solutions. In order to employ the polymers of the subject invention in the emulsification of ASA sizes, an aqueous solution must first be prepared of the polymer. In the case of the water-in-oil emulsions of vinyl addition polymers, we have found the water soluble surfactants used to invert the water-in-oil emulsions have no detrimental effect on the activity of the polymer used to emulsify the ASA size. When preparing a polymer solution from a water-in-oil emulsion polymer, a useful method or device for forming the solution is exemplified in U.S. Pat. No. 4,057,223 which discloses a mixing block.

Depending upon the molecular weight and cationic charge of the polymer, the final size emulsion added to the pulp furnish may contain from 0.01% to 25%, and preferably 0.01–10% by weight of polymer.

The ASA emulsions fed to the pulp slurry according to this invention will generally contain:

50–99.9% by weight water
0.01–50% by weight ASA
0.001–25.0% by weight of the water soluble polymer
0.00–2.0% by weight of a surfactant Preferably, these emulsions will contain:

50–99.9% water
0.01–40% ASA
0.010–10% polymer
0.00–1.0% surfactant

Most preferably the ASA emulsion contains 0.01–7.5 and generally 0.01–5.0 parts polymer.

The polymers are thus used in preparation of the dispersions or emulsions of the ASA sizing material.

The polymers of this invention may be used to emulsify the ASA, or may be added to previously formed ASA emulsions. In either case, the polymer will increase the performance of the emulsion compared to emulsions not containing the polymer. When the polymer is added to an ASA emulsion that has already been formed, conventional emulsifying agents should be used in addition to the polymer. When added or used during the make-up of the ASA emulsion, additional emulsifier is optional.

Agitation Energy

Prior to adding the ASA emulsions of this invention to a paper machine, it is common to expose the ingredients of the emulsions to a mixing pump which accomplishes a mixing of the pertinent ingredients of these emulsions. The mixing can be accomplished in several ways, the method of mixing being immaterial to the application as long as the results of the mixing are common to the materials. By results of mixing we mean that the mixing agitation devices that are used to admix the ingredients of the ASA emulsion must accomplish the formation of stable emulsions having an ASA particle size ranging between about 0.01 to about 5 microns in size. It is preferable that the admixing equipment be capable of forming emulsion sizes having a particle size ranging between about 0.5–3 microns, and it is most preferable that this equipment be able to form the ASA emulsion having a particle size below 2 microns and having a relatively narrow particle size distribution ranging between about 1.5+1 microns in size.

Preferably the ingredients of the ASA size are added into the feed side of a pump capable of emulsion formations, the discharge of this pump being split so that a portion of the discharge goes to the paper machine while another portion of the discharge is fed back to the feed point of the pump. By controlling the percentage of output of this type of pump which is recirculated back to the feedpoint of the pump, one may control the amount of energy that the components of the emulsion are exposed to and thereby control the quality of the emulsion formed by the ASA sized emulsion ingredients. The use of sufficient energy, as controlled by output recycle ratios, can control ASA size emulsion particle size within the ranges taught above. By controlling the ratio of output to feedback from the emulsifying pump one can control the particle size of the emulsion to achieve the desired physical characteristics of these ASA emulsion sizes.

Alternatively, the emulsion-forming pump may be operated such that no discharge is recycled to the feedpoint. To obtain adequate emulsion quality, it is then preferred that the pump be operated at pressures exceeding atmospheric pressures. Depending upon the type of pump being used to obtain the emulsion, the pressures should be in excess of atmospheric pressure by at least 1 lb./square inch, and most preferably should be in excess of atmospheric pressure by at least 100 lb./in.$^2$. The pressures referred above are the incoming head pressure.

The benefit of the instant invention includes the proper control of particle size of the emulsion by the use of the low molecular weight cationic polymers of this invention in combination optionally with the anionic emulsifiers used in this invention, preferably the phosphated ethoxylate esters used in this invention. If sufficient energy is available by appropriate equipment choice, the ASA sizes of this invention may optionally eliminate the use of additional emulsifier whether that emulsifier be anionic, non-ionic or cationic. In other words the sizing capacities obtained with the instant invention may be drastically improved by the use of either very low amounts of surfactant or with appropriate energy availability with the use of only the alkenyl succinic anhydride in combination with the low molecular weight cationic polymers of this invention within the prescribed weight ratios.

The Weight Ratios of Alkenyl Size To Cationic LMW Polymers

It is critical in the use of this invention to obtain certain ratios of the alkenyl succinic anhydride sizing agent to the low molecular weight cationic polymers of this invention. It is preferable that the ratios of ASA size to cationic low molecular weight polymer range between about 1:1 to about 20:1, preferably this ratio ranges between about 2:1 to about 15:1 and most preferably this ratio of ASA size to low molecular weight cationic polymer ranges between about 2.5:1 to about 10:1. Each of the ratios mentioned above refer to a weight ratio of active ingredients, not to a weight ratio of formulated or dissolved or dispersed ingredients. Therefore an ASA size emulsion containing the cationic ingredients of this invention might be applied to paper as an emulsion containing a solids content ranging between about 0.1 to about 10.0 weight percent, however, this solids content would contain the ratios of ASA size to cationic polymer taught above.

In order to test the subject invention, the following experiments were conducted. Thr polymers listed below were obtained commercially or prepared in the form indicated.

EXAMPLE 1

Solution acrylamide copolymers of types DMAEM-MeCl Quat, MAPTAC, and polyDADMAC of molecular weights ranging from 10,000 to 400,000, as well as several condensation polymers, were evaluated as ASA emulsification and retention aids. These novel sizing compositions were compared in terms of ASA particle size, physical emulsion stability and sizing performance to conventional ASA emulsions in water or cationic starch. Description of these polymers are given in Table I.

ASA emulsions in water were prepared by combining 95 parts of distilled water and 5 parts of ASA in an Eberbach semi-microemulsion cup. The mixture was dispersed for 3 minutes at high speed. The emulsion formed was diluted with distilled water to 0.50 percent ASA solids basis and used in Example 1. ASA emulsions in cationic starch were prepared by first hydrating 5 parts of a pregelatinized cationic potato starch in 95 parts of water and agitating for 30 minutes. Size emulsions were then prepared by combining 75 parts of the starch solution with 25 parts of ASA in the emulsion cup and dispersing for 20 seconds. This emulsion was diluted to 0.50 percent ASA solids basis and used in Example 2. Lastly, ASA emulsions in vinyl addition polymers were prepared by dispersing ASA on polymer solutions at a ratio of 5:1 solids basis. These emulsions were diluted to 0.50 percent ASA solids basis by the method described above. Examples 3–8 illustrate the novel use of these addition polymers.

The ASA emulsions were tested separately in a paper slurry of composition 50 percent recycled corrugated boxboard, 50 percent recycled newsprint. Other slurry parameters were 0.5 percent consistency, 400 Canadian Standard Freeness, pH 7.5, and 25 degrees Celsius to which was added 12.5 parts per million of hydrated aluminum sulfate. Handsheets of basis weight 50 pounds per 3300 square feet were prepared in accordance with TAPPI T-205 procedures. The sizing compositions listed above were added to the paper slurry shortly before wet-web formation at dosages of 0.10 and 0.15 percent on paper solids. Handsheets were immediately dried on rotary drum to 98 percent solids basis. Results are shown in Table I.

polyDADMAC, were further evaluated as ASA emulsification and retention aids. These novel sizing compositions were compared in terms of ASA emulsion particle size, physical emulsion stability with aging, and sizing performance to conventional ASA emulsions in water or cationic starch. The molecular weight of these polymers ranged from 10,000 to 400,000. A description of these polymers is shown in Table II.

ASA emulsions in water were prepared by combining 95 parts of distilled water and 5 parts of ASA in a laboratory 8 ounch Oster Miniblend Container, obtainable in most hardware stores. The mixture was dispersed at high speed for 3 minutes. The emulsion formed was diluted with distilled water to 0.50 percent ASA solids basis and used in Example 11. ASA emulsions in cationic starch solutions were prepared by first hydrating 5 parts of a pregelatinized cationic potato starch in 95 parts of water and agitating for 30 minutes. Size emulsions were then prepared by combining 95 parts of the starch solution with 5 parts of ASA in the Oster container and dispersing the size for 25 seconds. This emulsion was diluted to 0.50 percent ASA solids basis and used in Example 12. ASA emulsions in vinyl addition polymers were prepared by dispersing ASA in the polymer solutions at a ratio of 1:1 ASA to polymer solids in the Oster container for 5 to 30 seconds. These emulsions are then diluted to 0.50 percent ASA solids as described above. Examples 11–16 illustrate the novel use of these vinyl addition polymers.

Each ASA emulsion was tested separately in a paper slurry of composition 50 percent bleached softwood kraft and 50 percent beached hardwood kraft pulps. The other slurry parameters were 0.5 percent consistency, 330 Canadian Standard Freeness, pH 7.3, and 27 degrees Celcius. Handsheets of basis weight 50 pounds per 3300 square feet were prepared in accordance with

TABLE I

| Designation | Polymer Description | Weight Ratio | Molecular Weight[1] calculated from (Intrinsic Viscosity) |
|---|---|---|---|
| A | diallyldimethyl ammonium chloride Quat. | — | 82,000 |
| B | diallyldimethyl ammonium chloride Quat. | — | 235,000 |
| C | acrylamide-DMAEM methylchloride Quat. | 75:25 | 40,000 |
| D | acrylamide-DMAEM methylchloride Quat. | 75:25 | 210,000 |
| E | acrylamide-MAPTAC | 75:25 | 50,000 |
| F | acrylamide-MAPTAC | 75:25 | 380,000 |

| Example No. | Medium for Size[2] Emulsifications | Ratio of Size to Medium Solids | Average Particle Size of Emulsion (Microns) | Physical Emulsion[4] Stability (Form) | Acid Ink Penetration Test (in seconds)[5] Versus Percent by Weight of Size on Pulp Solids 0.100% | 0.150% |
|---|---|---|---|---|---|---|
| 1 | Distilled Water | — | 2–10 | Nonstable, two distinct phases | 2 | 15 |
| 2 | Cationic Potato Starch(STALOK 500)[3] | 5:1 | 1–2 | Nonstable, precipitated settled | 157 | 377 |
| 3 | Polymer A | 5:1 | 0.5–2 | Nonstable, two distinct phases | 191 | 392 |
| 4 | Polymer B | 5:1 | 1–2 | Stable | 263 | 434 |
| 5 | Polymer C | 5:1 | 1–3 | Stable | 116 | 249 |
| 6 | Polymer D | 5:1 | 0.5–2 | Stable | 157 | 322 |
| 7 | Polymer E | 5:1 | 1–2 | Stable | 71 | 204 |
| 8 | Polymer F | 5:1 | 1–2 | Stable | 135 | 278 |

[1]Intrinsic Viscosity $(n)_I$ run in 1 M $NaNO_3$ at 30° C. Molecular weights (MW) calculated from Mark-Houwink Equation: $(n)_I = (K)(MW)^2$
[2]Commercial paper grade alkenyl succinic anhydride
[3]Available from A. E. Staley, Decatur, Illinois
[4]Physical emulsion form after one week, room temperature aging
[5]Hercules' size test apparatus conducted at 80% reflectence with 1% formic acid; 1.25% napthol green test ink

EXAMPLES 2

Vinyl addition polymers, such as copolymers of acrylamide with DMAEM-meCl quat or MAPTAC, and TAPPI T-205 procedures. The sizing compositions listed above were added to the paper slurry shortly before wet web formation at the dosage of 0.20 percent ASA solids on paper solids. Handsheets were immediately pressed to approximately 50 percent residual moisture and dried on a rotary drum dryer to 98 percent paper solids basis. Results are shown in the attached Table II.

TABLE II

| Designation | Polymer Description | Weight Ratio Acrylamide to Quat | Molecular Weight[1] calculated from (Intrinsic Viscosity) |
|---|---|---|---|
| A | diallyldimethyl ammonium chloride Quat. | — | 82,000 |
| B | diallyldimethyl ammonium chloride Quat. | — | 235,000 |
| F | acrylamide-MAPTAC | 75:25 | 380,000 |
| G | acrylamide-MAPTAC | 50:50 | 140,000 |
| D | acrylamide-DMAEM methyl chloride Quat. | 75:25 | 210,000 |
| H | acrylamide-DMAEM methyl chloride Quat. | 50:50 | 90,000 |

| Example No. | Medium for ASA[2] Emulsification | Ratio of ASA to Medium Solids | Average Particle Size of ASA (Microns) | Physical[4] Emulsion Stability (Form) | Neutral Ink Penetration Test[5] (Seconds) at 0.40% ASA on Pulp Solids |
|---|---|---|---|---|---|
| 9 | Distilled Water | — | 1–5 | Nonstable, two distinct phases | <1 |
| 10 | Cationic Potato Starch(STALOK 500)[3] | 1:1 | 1–3 | Nonstable, precipitate settled | 273 |
| 11 | Polymer A | 1:1 | 1–3 | Nonstable, two distinct phases | 9 |
| 12 | Polymer B | 1:1 | 1–3 | Stable | 5 |
| 13 | Polymer F | 1:1 | 0.5–2 | Stable | 71 |
| 14 | Polymer G | 1:1 | 1–2 | Stable | 246 |
| 15 | Polymer D | 1:1 | 0.5–1 | Stable | 227 |
| 16 | Polymer H | 1:1 | 0.5–2 | Stable | 17 |

[1]Intrinsic Viscosities $(n)_I$ run in 1 M $NaNo_3$ at 30° C. Molecular weights (MW) calculated from Mark-Houwink Equation: $(n)_I = (K)(MW)^2$
[2]Commercial paper grade alkenyl succinic anhydride
[3]Available from A. E. Staley, Decatur, Illinois
[4]Physical emulsion form after one week, room temperature aging
[5]Hercules' size test apparatus conducted at 80% reflectence with 1% sodium formate (pH 7.0) and 1.25% napthol green test ink

EXAMPLES 3

The following examples further illustrate the novel use of acrylamide copolymers of type DMAEM-MeSQ, DMAEA-MeSQ, DEAEA-MeSQ and DADMAC of molecular weights greater than 1,000,000 as emulsifiers and retention aids for alkenyl succinic anhydride sizing compositions. The ASA emulsions thus formed were compared in terms of particle size and sizing performance with respect to ASA water emulsions and conventional emulsions prepared from cationic starch.

For comparison, ASA emulsions in water were prepared by combining 95 parts of distilled water and 5 parts of ASA in an Eberbach semi-microemulsion cup and dispersing the size for 60 seconds. The resulting emulsion was diluted to 0.50 percent ASA solids basis with water and used in Example 19. The ASA emulsions in cationic starch were prepared by first hydrating three parts of a pregelatinized cationic potato starch in 97 parts agitated cold water for 30 minutes. Emulsions were then prepared at two ASA to starch solids ratios of 10:1 and 3:1 by dispersing 30 parts of ASA in 70 parts of 3 percent cationic starch or 9 parts of ASA in 91 parts of 3 percent cationic starch respectively with the aid of the semi-microemulsion cup. The resulting emulsions were diluted to 0.5 percent ASA solids basis with water and used in Examples 21 and 22 accordingly.

Polymer solutions were prepared by hydrating 0.6 parts (as polymer solids) of those copolymers of acrylamide listed below in 99.4 parts of water respectively, allowing sufficient time and mixing for complete hydration. Emulsions were than prepared at two ASA to polymer solids ratios of 10:1 and 3:1 by dispersing 6 parts of ASA in 94 parts of 0.6 percent polymer solids solution or 1.8 parts of ASA in 98.2 parts of 0.6 percent polymer solids solution respectively with the aid of the semi-microemulsion cup.

A further dilution to 0.5 percent ASA solids was then taken. The following example illustrates the advantages offered by this invention: the ability of these cationic water soluble acrylamide copolymers to initiate an ASA emulsion and to render the ASA emulsion particles cellulose substantive.

Each of the below cited ASA emulsions were separately added to a 0.5 percent consistency pulp slurry of composition 40 percent bleached hardwood sulfate pulp, 40 percent bleached softwood sulfate pulp of 300 Canadian Standard Freeness, and 20 percent calcium carbonate (pH 8.2). Handsheets of basis weight 50 pounds per 3300 square feet were prepared in accordance with TAPPI T-205 procedures. Emulsions of ASA were added to the pulp slurry shortly before wet-web formation at dosages of 0.250 and 2.00 percent on dry pulp solids. Handsheets were pressed to 50 percent residual moisture and immediately dried on a rotary drum dryer to 98 percent solids basis (2 percent residual moisture). Results are shown in Table III.

EXAMPLE 3.

TABLE III

POLYMERS

| Designation | Acrylamide Copolymer Quats | Molecular Weight[1] calculated from Intrinsic Viscosity | Form |
|---|---|---|---|
| I | DMAEA, methylchloride quat. | 5,700,000 | dry powder |
| J | 12 wt. %-DEAEA, monomethyl sulfate salt | 9,200,000 | dry powder |
| K | 12.5 wt. %-DMAEM, monomethyl sulfate quat. | — | dry powder |

TABLE III-continued

| POLYMERS | | | |
|---|---|---|---|
| L | 25 wt. %-DMAEM, monomethyl sulfate quat. | 8,900,00 | emulsion |
| M | 28.6 wt. %-DADMAC | 4,300,000 | emulsion |

| Example No. | Medium for Size[2] Emulsifications | Ratio of Size To Medium Solids | Avg. Particle Size Of Emulsion (microns) | Neutral Ink Penetration Test[5] (in seconds) vs. Percent By Weight Size on Dry Pulp Solids 0.250% | 2.000% |
|---|---|---|---|---|---|
| 17 | Distilled Water | — | 2–20 | 1 | 423 |
| 18 | Distilled Water Plus Surfactant[3] | — | 1–4 | 1 | 255 |
| 19 | Cationic Potato Starch(STALOK 400)[4] | 3:1 | 1–2 | 310 | — |
| 20 | STALOK 400[4] | 10:1 | 1–3 | 282 | — |
| 21 | Polymer I | 3:1 | 1–3 | 656 | — |
| 22 | Polymer J | 3:1 | 1–3 | 426 | — |
| 23 | Polymer K | 3:1 | 1–3 | 464 | — |
| 24 | Polymer L | 10:1 | 0.5–4 | 468 | — |
| 25 | Polymer M | 10:1 | 0.5–2 | 313 | — |

[1]Intrinsic Viscosity $(n)_I$ run in 1 M $NaNO_3$ at 30° C. Molecular weights (MW) calculated from Mark Houwink Equation: $(n)_I = (K)(MW)^2$.
[2]Commercial paper grade ASA
[3]Surfactant type: nonylphenol ethoxylate dosed at 5.0% by weight of sizing agent
[4]Available from A. E. Staley, Decatur, Illinois
[5]Hercules size test apparatus conducted at 80% reflectence
DMAEA = dimethylaminoethylacrylate
DEAEA = diethylaminoethylacrylate
DMAEM = dimethylaminoethylmethacrylate
DADMAC = diallyldimethylammoniumchloride This example clearly illustrates the novel use of cationic vinyl addition copolymers as ASA emulsification aids and emulsion retention aids. Improved water resistance is realized over conventional ASA in water or cationic starch emulsions. Secondly, the improved water resistance offered by this invention cannot be attributed simply to improved papermachine retention as demonstrated by separate additions of these same cationic polymers to the paper furnish.

The use of polymers in this molecular weight range, however, led to the formation of tacky deposits and unstable emulsions. Further research as exemplified herein has shown that polymers having a molecular weight greater than 10,000 but lower than 1,000,000, and preferably from 20,000 to 750,000, performed essentially equivalent to polymers having higher molecular weight. In addition, the use of polymers having molecular weights in these ranges led to the elimination of the deposit formation noted above, and increased the stability of the ASA emulsions so prepared. The support for this conclusion is given in Table IV.

For comparison, ASA emulsions in water were prepared by combining 95 parts of deionized water and 5 parts of ASA in an 8 oz. Oster Miniblend Container. The mixture was dispersed at high speed for 3 minutes. The emulsion thus formed was diluted to 0.50 percent ASA with deionized water and used in Example 26.

ASA emulsions in cationic potato starch obtained from a supplier in the Netherlands were prepared by first hydrating 4 parts of the pregelatinized starch in 96 parts of deionized water for 30 minutes. ASA emulsions in cationic starch were prepared by combining 50 parts of the 4 percent starch solution, 10 parts of ASA and 40 parts deionized water in the Oster container and dispersing the composition for 60 seconds. The emulsion was diluted to 0.5 percent ASA with deionized water and used in Example 27.

ASA emulsions in low molecular cationic acrylamide (Acrylamide/DMAEM-MCQ copolymer, hereafter Polymer D) were prepared by combining 2 parts of cationic acrylamide, 10 parts of ASA and 88 parts deionized water in the Oster container and blending for 60 seconds at high speed. The emulsion was diluted to 0.5 percent ASA with deionized water and used in Example 28 which contains the anionic surfactant. A fifth emulsion was prepared in low molecular weight cationic acrylamide, Polymer D, using ASA not containing surfactant. The ratios of components were as described under the low molecular weight cationic acrylamide section, 2:10:88 parts of polymer:ASA:deionized water respectively. Blending to the desired ASA particle size required 120 seconds. Example 29 reflects the ASA sizing composition not using an additional emulsifier.

An ASA emulsion in high molecular weight cationic acrylamide (Acrylamide/DMAEM-MSQ copolymer, hereafter Polymer L) was prepared by first hydrating 0.6 parts of polymer in 99.4 parts of deionized water for 30 minutes. ASA emulsions in the high molecular weight cationic acrylamide were prepared by combining 97.1 parts of the 0.6 percent polymer solutions with 2.9 parts of ASA in the Oster container and dispersing for 90 seconds. The emulsion was diluted to 0.5 percent ASA with deionized water and used in Example 30.

Each ASA emulsion was comparatively checked for emulsion stability and sizing efficiency. Each emulsion, following dilution to 0.5 percent ASA solids, was aged for 24 hours at room temperature and monitored for physical emulsion stability, e.g. emulsion agglomeration, coalescence or precipitation. A visual description was noted. Sizing efficiency of freshly prepared emulsion was measured in a paper slurry of composition 50 parts recycle corrugated boxboard and 50 parts recycle printed newsprint. Other slurry parameters were 0.5 percent consistency, 380 Canadian Standard Freeness, pH 7.5 and 25 degrees Celsius in deionized water. Handsheets of basis water 50 pound per 3,300 square feet were prepared in accordance with TAPPI T-205 procedures. The emulsions described above were added separately to the paper slurry shortly before wet-web formation at an ASA dosage of 0.20 percent on paper solids. Handsheets were pressed to 50 percent moisture and immediately dried on a rotary drum. Results are shown in Table IV.

TABLE IV

| Designation | Polymer Description | Weight Ratio | Molecular Weight[1] calculated from Intrinsic Viscosity |
|---|---|---|---|
| Polymer D | acrylamide - DMAEM methyl-chloride quat | 75:25 | 156,000 |
| Polymer L | acrylamide - DMAEM monomethyl-sulfate quat | 75:25 | 7,100,000 |

| Example No. | Medium for ASA[2] Emulsification | Ratio of ASA to Medium Solids | Particle Size of ASA (in Microns) | Physical[3] Emulsion Stability (Form) | Acid Ink[4] Penetration Test (in seconds) |
|---|---|---|---|---|---|
| 26 | Deionized Water | — | 0.5–5 | Nonstable Coalesced Two-phase | 3 |
| 27 | Cationic Potato Starch | 5:1 | 0.5–3 | Nonstable Precipitate Settled | 649 |
| 28 | Polymer D | 5:1 | 0.5–3 | Stable | 784 |
| 29 | Polymer D (No surfactant in ASA) | 5:1 | 0.5–5 | Stable | 917 |
| 30 | Polymer L | 5:1 | 0.5–3 | Nonstable Precipitate Floated | 1067 |

[1]Intrinsic Viscosity $(n)_I$ run in 1M $NaNO_3$ at 30° C. Molecular weights (MW) calculated from Mark-Houwink Equation

[2]Commercial paper grade alkenylsuccinic anhydride (ASA)

[3]24-Hour emulsion aging at 0.5 percent ASA, room temperature storage

[4]Hercules size test apparatus conducted at 80 percent reflectence with 1 percent formic acid; 1.25 percent napthol green ink In addition, we have developed a test procedure which measures paper machine runnability. This procedure measures the potential of any ASA emulsion formulation to develop problems such as press picking, felt filling and poor cylinder vat consistency control. This test is referred to below as the Novak Felt Test and measures the tendency of a standard paper machine press felt to clog with deposits formed in the presence of ASA size emulsions used in combination with various cationic agents.

This Novak Felt Test circulates an emulsion of ASA sizing agent as an emulsion formulation containing various and controlled amounts of different cationic agents through a filter apparatus, in which the filter media is a sample of a standard felt normally used in the press section of a paper machine. The emulsions circulating through this apparatus are pumped at a constant ½ GPM using a piston pump having a one inch twin head. The temperature of the test solution is controlled at pre-set levels by circulation of the test emulsions through a controlled heat resevoir. Temperature and pressures are measured by appropriate gauges.

As circulation is continued, the felt filter tends to plug with debris, mainly by-products formed by the hydrolysis of ASA and the interaction of the ASA sizing agent and its hydrolysate with the polymeric cationic agents. Filter plugging is measured by an increase in the line pressure observed between the piston pump and the filter. The graph depicted in the drawing gives results which indicates that very high molecular weight acrylamide polymers, which have been cationically modified, or which contain cationic monomers such as those listed above, rapidly blind the felt filter. We have observed that these same types of high molecular weight cationic material give good sizing properties when used in ASA sizing emulsions, but fail commercially because of felt filling, press picking and paper machine deposit formation.

BRIEF DESCRIPTION OF DRAWING

The cationic starches prominently used commercially yield a better runnability result, as illustrated in the drawing, but still eventually cause deposit formation and runnability problems, such as felt filling, press picking, machine deposits and the like.

Finally, the drastically improved results of the instant invention are also illustrated in the drawing. Runnability is greatly improved over those characteristics as made available through use of the prior art. Also, sizing properties are maintained. This unexpected or superior runnability achieves an economical advantage using the ASA size emulsions containing the low molecular weight cationic vinyl water-soluble polymers of this invention, optionally in the presence of emulsifiers, preferably the phophated ethoxylates, and when the ASA particle size is between about 0.1–5 microns in diameter.

Figure 1:
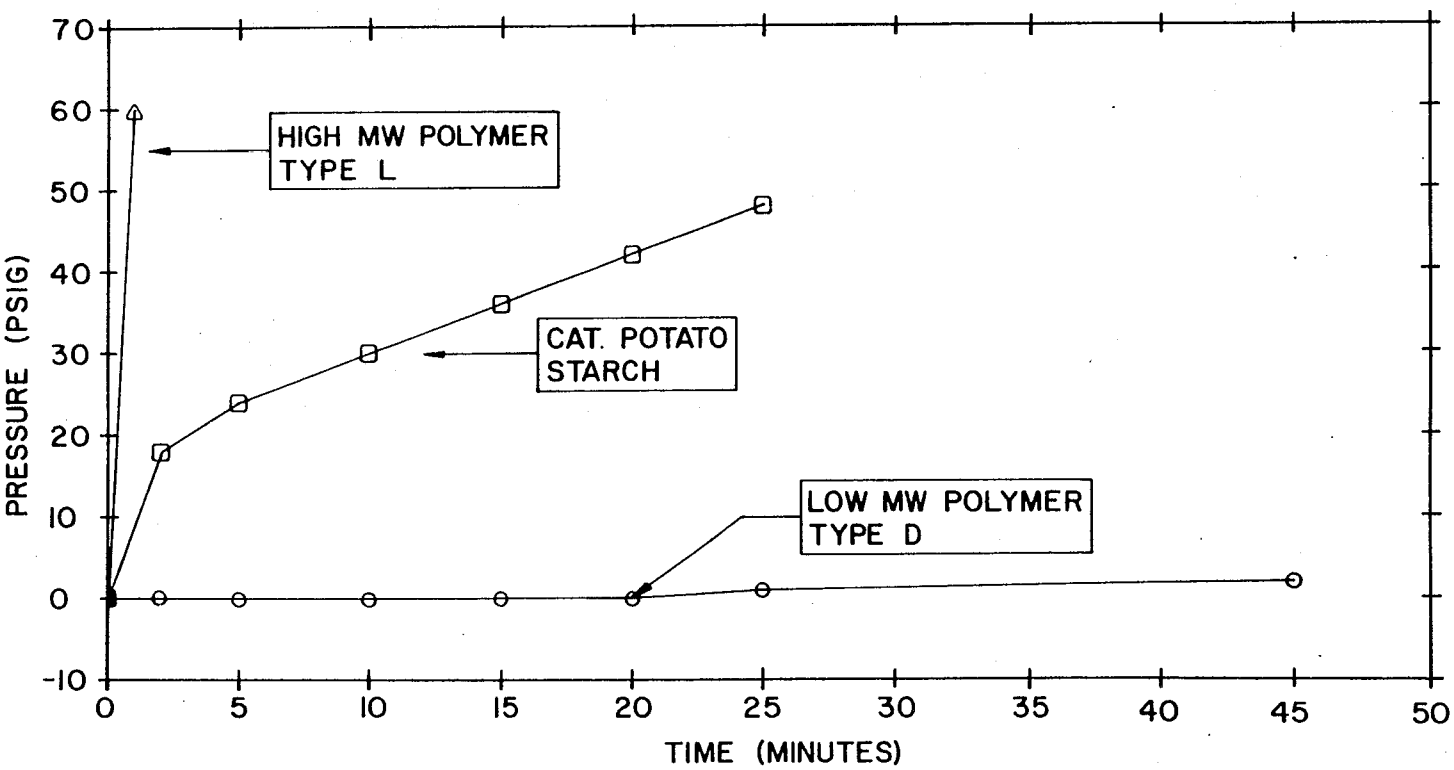

Having thus described our invention, we claim:

1. In the process of preparing sized paper products, which process uses an effective amount of an emulsified alkenyl succinic anhydride sizing agent containing water, alkenyl succinic anhydride, surfactants, and a cationic polymer, the improvement which comprises the use as the cationic polymer of a water-soluble cationic vinyl addition polymer having a molecular weight below about 1,000,000; the use as the surfactant of a phosphated ethoxylate or sulfonated emulsifier at a concentration of from 0.0 to about 2.0 weight percent; and the use of pre-application agitation having sufficient energy to achieve an alkenyl succinic anhydride particle size not exceeding 5 micron in diameter, and wherein the weight ratio of active alkenyl succinic anhydride to active cationic vinyl polymer ranges between about 1:1 to about 15:1.

2. The method of claim 1 wherein the cationic vinyl addition polymer is selected from water soluble vinyl addition polymers having molecular weights greater then 10,000 and less than 1,000,000, said polymer having at least 10 weight percent and up to 100 weight percent of the mer content of the polymer made from a cationic or cationically modified vinyl addition monomer.

3. The method of claim 2 wherein the cationic or cationically modified vinyl addition monomer is selected from the group consisting of:

a. diallyldimethyl ammonium chloride;
b. methacrylamidopropyltrimethyl ammonium chloride;
c. dimethylaminoethylmethacrylate;
d. dimethylaminoethylmethacrylate quaternaries;
e. dimethylaminoethylacrylate;
f. dimethylaminoethylacrylate quaternaries;
g. diethylaminoethylacrylate;
h. diethylaminoethylacrylate quaternaries;
i. acrylamide reacted with formaldehyde and a lower secondary amine through the Mannich reaction; and
j. Manniched acrylamide quaternaries.

4. The method of claim 1 wherein the weight ratio of alkenyl succinic anhydride size to polymer range between about 2:1 to 15:1.

5. In a method for the sizing of paper using an alkenyl succinic anhydride size wherein an emulsion of alkenyl succinic anhydride is applied to the paper stock, the improvement comprising using as an emulsifier for the alkenyl succinic anhydride size, a water soluble cationic vinyl addition polymer having a molecular weight greater than 10,000 and less than 1,000,000 in combination with an anionic surfactant wherein the ratio of cationic polymer to anionic surfactant ranges between about 100:1 to about 1:0.

6. The method of claim 5 wherein the cationic water soluble vinyl addition polymer is selected from the group consisting of homo and copolymers of one or more of the following monomers:

a. diallyldimethyl ammonium chloride;
b. methacrylamidopropyltrimethyl ammonium chloride;
c. dimethylaminoethylmethacrylate;
d. dimethylaminoethylmethacrylate quaternaries;
e. dimethylaminoethylacrylate;
f. dimethylaminoethylacrylate quaternaries;
g. diethylaminoethylacrylate;
h. diethylaminoethylacrylate quaternaries;
i. acrylamide reacted with formaldehyde and a lower secondary amine through the Mannich reaction; and
j. Manniched acrylamide quaternaries.

7. The method of claim 5 wherein the emulsion containing the water soluble polymer is added to the paper stock.

8. An emulsion of alkenyl succinic anhydride comprising:

a. 50–99.9 percent by weight water
b. 0.01–40 percent by weight of an alkenyl succinic anhydride
c. 0.001–10.0 percent by weight of a water soluble cationic vinyl addition polymer having a molecular weight greater than 10,000.

9. The emulsion of claim 8 wherein the water soluble cationic vinyl addition polymer is selected from the group consisting of homo and copolymers of:

a. diallyldimethyl ammonium chloride;
b. methacrylamidopropyltrimethyl ammonium chloride;
c. dimethylaminoethylmethacrylate;
d. dimethylaminoethylmethacrylate quaternaries;
e. dimethylaminoethylacrylate;
f. dimethylaminoethylacrylate quaternaries;
g. diethylaminoethylacrylate;
h. diethylaminoethylacrylate quaternaries;
i. acrylamide reacted with formaldehyde and a lower secondary amine through the Mannich reaction; and
j. Manniched acrylamide quaternaries.

10. A paper sizing emulsion comprising:

a. 50–99.9 weight percent water
b. 0.01–40.0 weight percent alkenyl succinic anhydride;
c. 0.01–10.0 weight percent cationic polymer having a molecular weight between 10,000–1,000,000 and
d. 0.000–2.00 weight percent of an anionic surfactant having an HLB ranging between 8–30.

11. The method of claim 10 wherein the cationic polymer is a polymer of epi-chlorohydrin and dimethylamine.

12. The paper sizing emulsion of claim 10 which contains as the anionic surfactant a phosphated ethoxylate.

* * * * *